US009337581B1

(12) United States Patent
Dong et al.

(10) Patent No.: US 9,337,581 B1
(45) Date of Patent: May 10, 2016

(54) HDMI CONNECTOR WITH ANTI-MISINSERTION STRUCTURE

(71) Applicant: T-CONN PRECISION CORPORATION, New Taipei (TW)

(72) Inventors: Chao Dong, ZhongShan (CN); Wu-Lin Liu, ZhongShan (CN)

(73) Assignee: T-CONN PRECISION CORP., Taipei (TW)

( * ) Notice: Subject to any disclaimer, the term of this patent is extended or adjusted under 35 U.S.C. 154(b) by 0 days.

(21) Appl. No.: 13/855,698

(22) Filed: Apr. 2, 2013

(51) Int. Cl.

| | |
|---|---|
| ***H01R 24/00*** | (2011.01) |
| ***H01R 13/64*** | (2006.01) |
| ***H01R 24/60*** | (2011.01) |
| *H01R 107/00* | (2006.01) |

(52) U.S. Cl.
CPC ..... *H01R 13/64* (2013.01); *H01R 24/60* (2013.01); *H01R 2107/00* (2013.01)

(58) Field of Classification Search
CPC ..... H01R 13/64; H01R 24/60; H01R 2107/00
USPC ..... 439/676, 660, 680, 347, 638, 862, 350, 439/357–358, 631, 632, 607.01, 607.58, 439/639
See application file for complete search history.

(56) References Cited

U.S. PATENT DOCUMENTS

| | | | | |
|---|---|---|---|---|
| 8,287,299 | B2 * | 10/2012 | Ray | H01R 13/6273 439/353 |
| 8,535,097 | B2 * | 9/2013 | Yen | H01R 12/724 439/607.27 |
| 9,004,941 | B2 * | 4/2015 | Wang | H01R 24/60 439/607.01 |

* cited by examiner

*Primary Examiner* — Edwin A. Leon
(74) *Attorney, Agent, or Firm* — Bacon & Thomas, PLLC

(57) ABSTRACT

A HDMI connector with anti-misinsertion structure includes a metallic case, a U-shaped plate, and a terminal base. The U-shaped plate is disposed on the upper surface of the metallic case, its front ends at which two push resilient plates and a block are disposed, respectively, its rear ends which extend to form two front arm potions connected to the push resilient plates and the block, and extends backward to form two rear arm portions and two base portions. The terminal base is installed thereon a terminal set. The anti-misinsertion structure is integrally formed with the metallic case to reduce manufacturing costs and boost linking-up and stopping strength of the anti-misinsertion structure, thereby preventing the non-HDMI plug from being inserted into the HDMI connector.

10 Claims, 12 Drawing Sheets

1-1

1-2

HDMI CONNECTOR WITH ANTI-MISINSERTION STRUCTURE

BACKGROUND OF THE INVENTION

1. Technical Field

The present invention relates to a HDMI connector with anti-misinsertion structure, and more particularly, to a HDMI connector with a metallic case on which an anti-misinsertion structure is disposed to prevent a USB plug from being inserted into the HDMI connector wrongly.

2. Description of Related Art

Electronic technology is ever-changing and widely applied to personal computers. Electronic devices are connected by signal transmission lines to transmit signals. At present, connecting a signal transmission line to an electronic device requires inserting a plug at one end of the signal transmission line into a connector of the electronic device. High Definition Multimedia Interface (HDMI) is the commonest signal transmission specification for display apparatuses. HDMI is an interface for transmitting fully digitized images and sounds, and is effective in transmitting non-compressed audio signals and video signals, allowing the audio and video signals to be transmitted with the same cable, so as to simplify the system installation greatly, wherein HDMI Type D is for use with HDMI 1.4 version, with a total of 19 pins, and specified dimensions of 2.8 mm×6.4 mm.

The aforesaid HDMI Type D plug and a USB plug are similar in shape, but are different in specifications. The dimension specifications of the HDMI Type D plug are slightly larger than that of the USB plug, and thus users are likely to insert the USB plug into the HDMI Type D connector mistakenly; as a result, a conductive terminal of the HDMI Type D connector is bent and damaged when prodded improperly by the USB plug.

Referring to FIG. 8, the prior art, such as Taiwan Published Patent Number 201223021 entitled "Structure For preventing Improper Insertion Of Connector", discloses an improper insertion of a connector, wherein an improper plug will not be inserted mistakenly into a receptacle. A first shield case(16) of a receptacle is provided, at each of both end sections in the width direction thereof, with: an arm(18) that is folded back in the forward direction from a base end section(68) anchored to the rear end section of an upper face wall(16*a*), and extends towards the forward direction; a stopper wall(20) that is formed at a free-end section(66) of the arm(18), protrudes into the inner side of the first shield case(16) from outside thereof, and that comes in contact with an improper plug when the improper plug is inserted; a plug pick-up section (22) that is formed at the free-end section(66) of the arm(18), that is formed integrally with the stopper wall(20) in parallel thereto, that protrudes into the inner side of the first shield case(16) from outside thereof, and that comes in contact with a proper plug when the proper plug is inserted; and a hole(24) that is formed near an opening(14) of the upper face wall (16*a*), and through which the stopper wall(20) and the plug pick-up section(22) are inserted. However, the two arms 18 of the conventional structure for preventing improper insertion of connector are disposed on two sides of the top surface of a connector socket 10, and, as a result, the two arms 18 of the conventional structure for preventing improper insertion of connector manifest either inadequate linking-up and stopping strength or an overly weak upward pushing force generated from the insertion of a HDMI plug, and in consequence the two arms 18 are unfit to move the anti-misinsertion structure. Hence, the conventional anti-misinsertion structure is inefficient and thus likely to cause damage to products or renders it difficult for the HDMI plug to be inserted into its connector.

Accordingly, it is imperative to provide a HDMI connector with anti-misinsertion structure, such that the HDMI connector enables the anti-misinsertion structure to be integrally formed with a metallic case, speeds up a manufacturing process thereof, cuts material costs so as to reduce the total manufacturing costs, and boosts the linking-up and stopping strength of the anti-misinsertion structure to thereby prevent a non-HDMI plug from being inserted into the HDMI connector.

SUMMARY OF THE INVENTION

It is an objective of the present invention to provide a HDMI connector with anti-misinsertion structure, such that the HDMI connector enables the anti-misinsertion structure to be integrally formed with a metallic case, speeds up a manufacturing process thereof, cuts material costs so as to reduce the total manufacturing costs, and boosts the linking-up and stopping strength of the anti-misinsertion structure to thereby prevent a non-HDMI plug from being inserted into the HDMI connector.

In order to achieve the above and other objectives, the present invention provides a HDMI connector with anti-misinsertion structure, comprising: a metallic case, wherein a plurality of press resilient plates is disposed at a front end of an upper surface of the metallic case, wherein two channels and an opening are disposed at two lateral sides and a middle of the metallic case, respectively, wherein a rib portion is disposed at a rear end of the upper surface of the metallic case, wherein at least one engagement portion and a plurality of pins are disposed on the two lateral sides of the metallic case, the metallic case having therein an insertion space into which a HDMI plug is inserted; a U-shaped plate disposed on the upper surface of the metallic case, having front ends at which two push resilient plates and a block are disposed, respectively, having rear ends extending to form two front arm portions connected to the push resilient plates and the block, and extending backward to form two rear arm portions and two base portions; and a terminal base is installed a terminal set, wherein the U-shaped plate is connected to the metallic case by means of the base portions, wherein the block is received in the opening of the metallic case, wherein the block abuts against a front-end top portion of a non-HDMI plug to prevent the non-HDMI plug from being inserted into the insertion space.

In a preferred embodiment of the present invention, both a front end and a rear end of a plurality of press resilient plates of the metallic case are integrally formed with the metallic case.

In a preferred embodiment of the present invention, these channels disposed at the metallic case receive the push resilient plates, respectively.

In a preferred embodiment of the present invention, the rib portion of the metallic case is integrally formed with the base portions.

In a preferred embodiment of the present invention, the push resilient plates each have a hook portion and an extension portion, and a push surface of the hook portion can come into contact with the front-end top portion of a HDMI plug, wherein the extension portion is connected to the front arm portion.

In a preferred embodiment of the present invention, a rear arm portion of the U-shaped plate extends straightly to the base portions at a rear end of the metallic case, and another rear arm portion of the U-shaped plate extends upward and vertically to the base portions at a rear end of the metallic case.

In a preferred embodiment of the present invention, the U-shaped plate and the metallic case are integrally formed as a unitary or a two-piece structure and connected to each other by means of the base portions.

In another preferred embodiment of the present invention, a HDMI connector with anti-misinsertion structure, comprising: a metallic case, wherein a plurality of press resilient plates is disposed at a front end of an upper surface of the metallic case, wherein two channels and an opening are disposed at two lateral sides and a middle of the metallic case, respectively, wherein a rib portion is disposed at a rear end of the upper surface of the metallic case, wherein at least one engagement portion and a plurality of pins are disposed on the two lateral sides of the metallic case, the metallic case having therein an insertion space into which a HDMI plug is inserted; a rhomboidal plate disposed on the upper surface of the metallic case, having front ends at which two push resilient plates and a block are disposed, respectively, having rear ends extending to form two front arm portions connected to the push resilient plates and the block, and extending backward to form two rear arm portions and a base portion; and a terminal base is installed a terminal set, wherein the rhomboidal plate is connected to the metallic case by means of the base portion, wherein the block is received in the opening of the metallic case, wherein the block abuts against a front-end top portion of a non-HDMI plug to prevent the non-HDMI plug from being inserted into the insertion space.

In another preferred embodiment of the present invention, the rear arm portions of the rhomboidal plate extend straightly and obliquely backward to be connected before extending to the base portions at a rear end of the metallic case.

In another preferred embodiment of the present invention, the rhomboidal plate and the metallic case are integrally formed as a unitary or a two-piece structure and connected to each other by means of the base portions.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE EMBODIMENTS OF THE INVENTION

Figure 1:
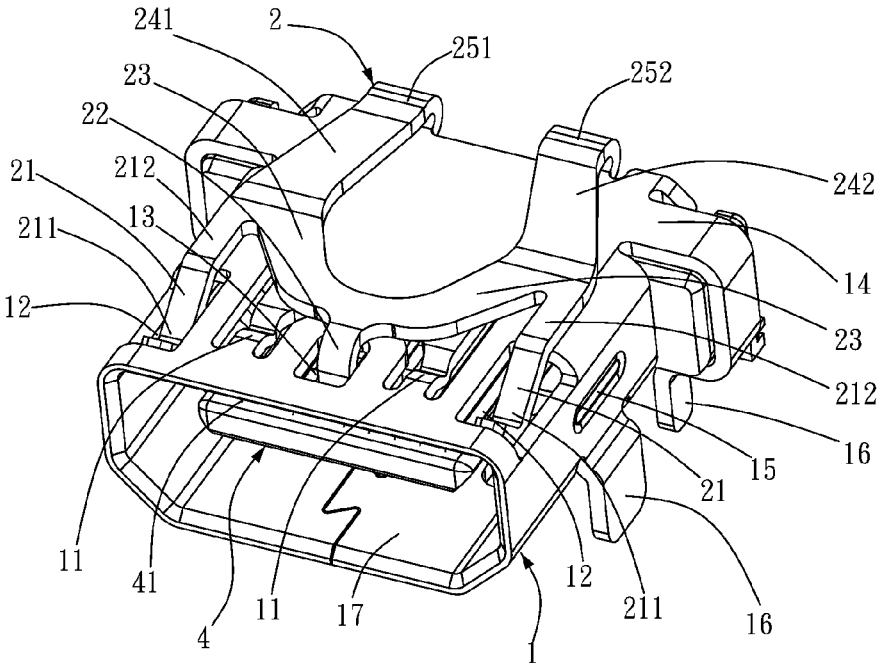
FIG. 1 is a perspective view of a HDMI connector with anti-misinsertion structure according to the present invention.
Figure 1:
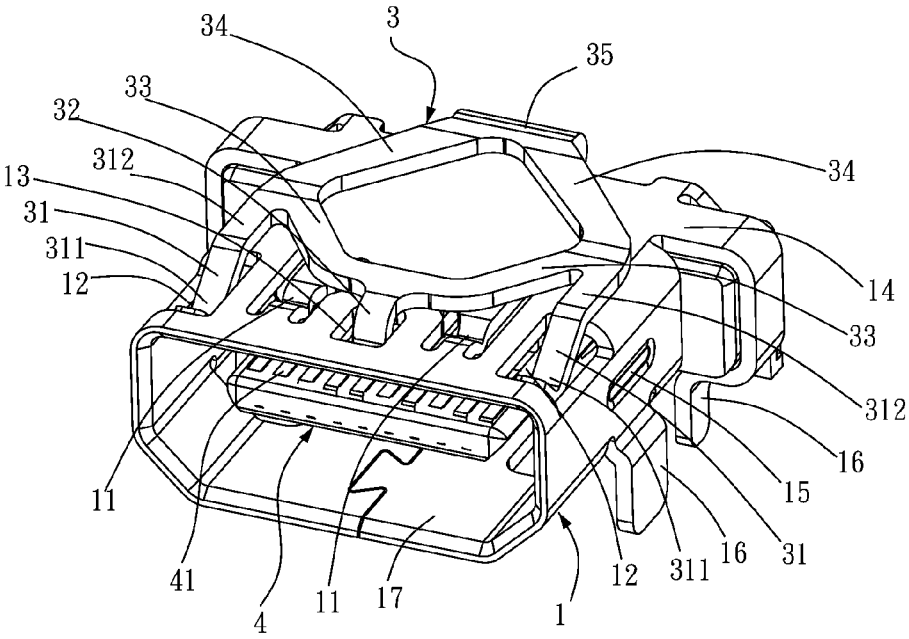
Figure 2:
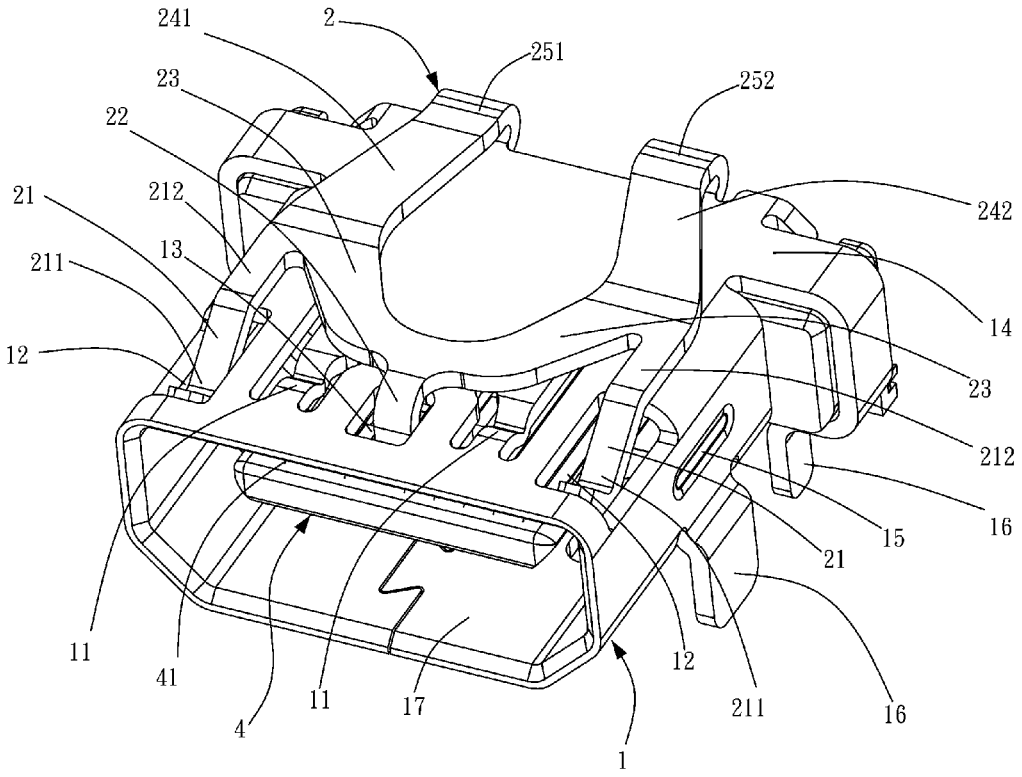
FIG. 2 is a perspective view of the HDMI connector with anti-misinsertion structure having a U-shaped plate according to the present invention.
Figure 3A:
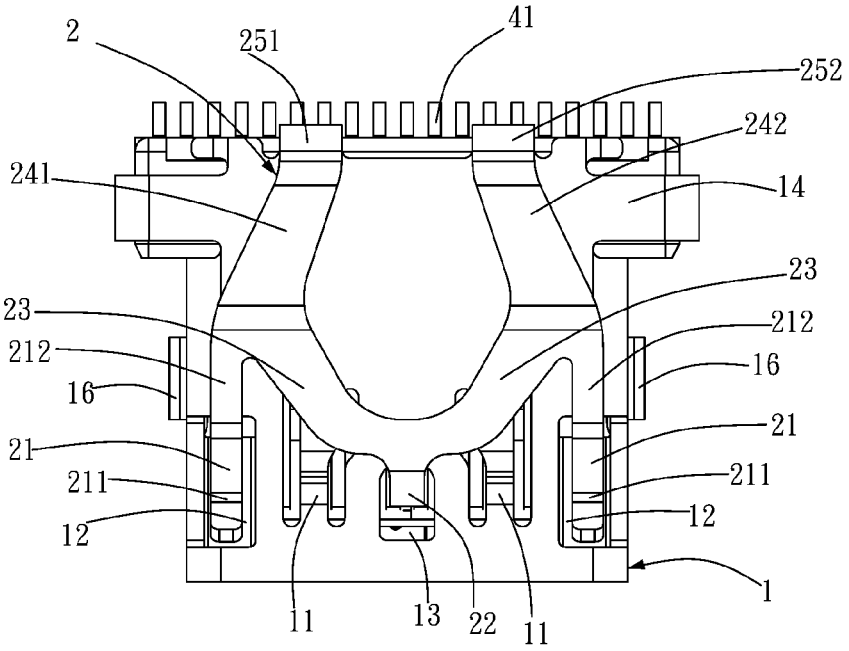
FIG. 3A is a top view of the HDMI connector with anti-misinsertion structure having a U-shaped plate according to the present invention.
Figure 3B:
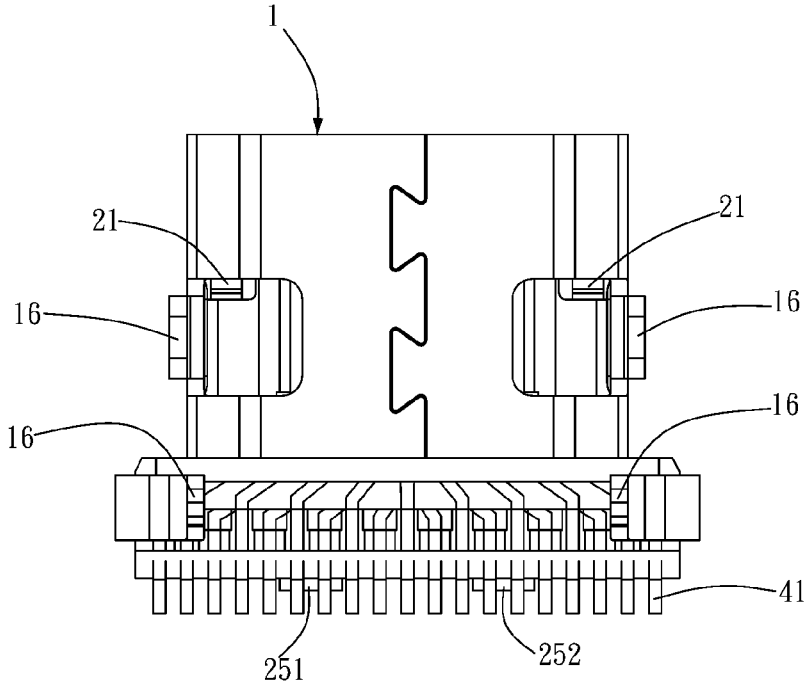
FIG. 3B is a bottom view of the HDMI connector with anti-misinsertion structure having a U-shaped plate according to the present invention.
Figure 3C:
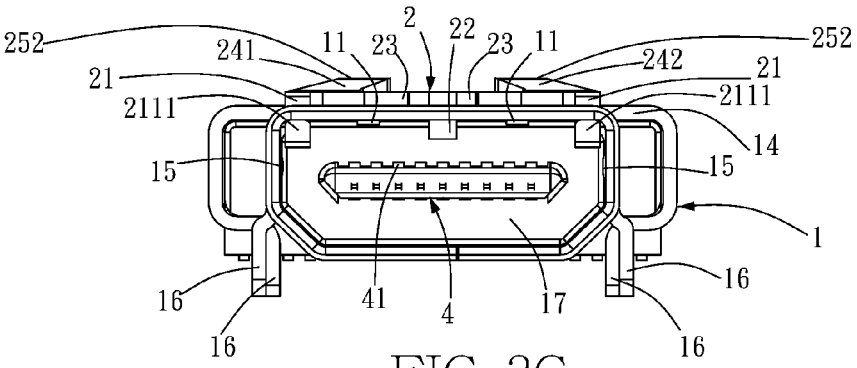
FIG. 3C is a front view of the HDMI connector with anti-misinsertion structure having a U-shaped plate according to the present invention.
Figure 3D:
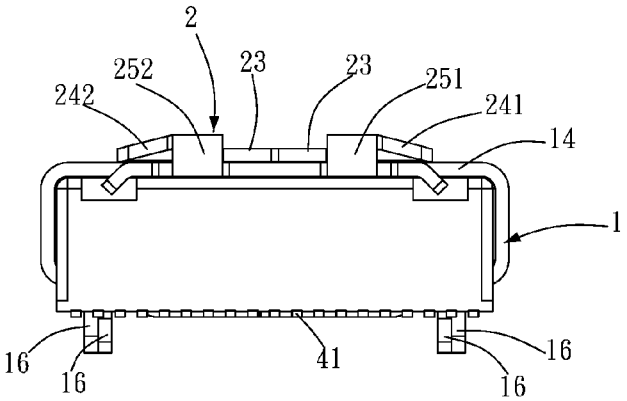
FIG. 3D is a rear view of the HDMI connector with anti-misinsertion structure having a U-shaped plate according to the present invention.
Figure 3E:
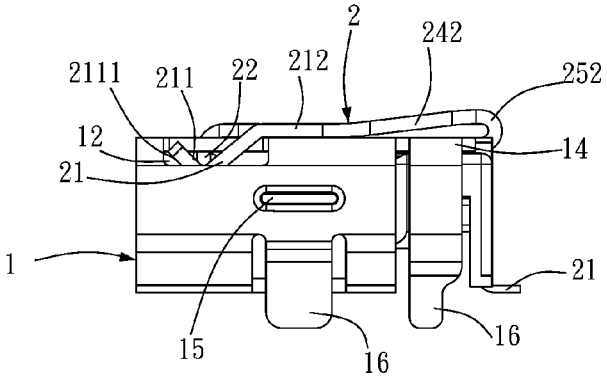
FIG. 3E is a lateral view of the HDMI connector with anti-misinsertion structure having a U-shaped plate according to the present invention.
Figure 4:
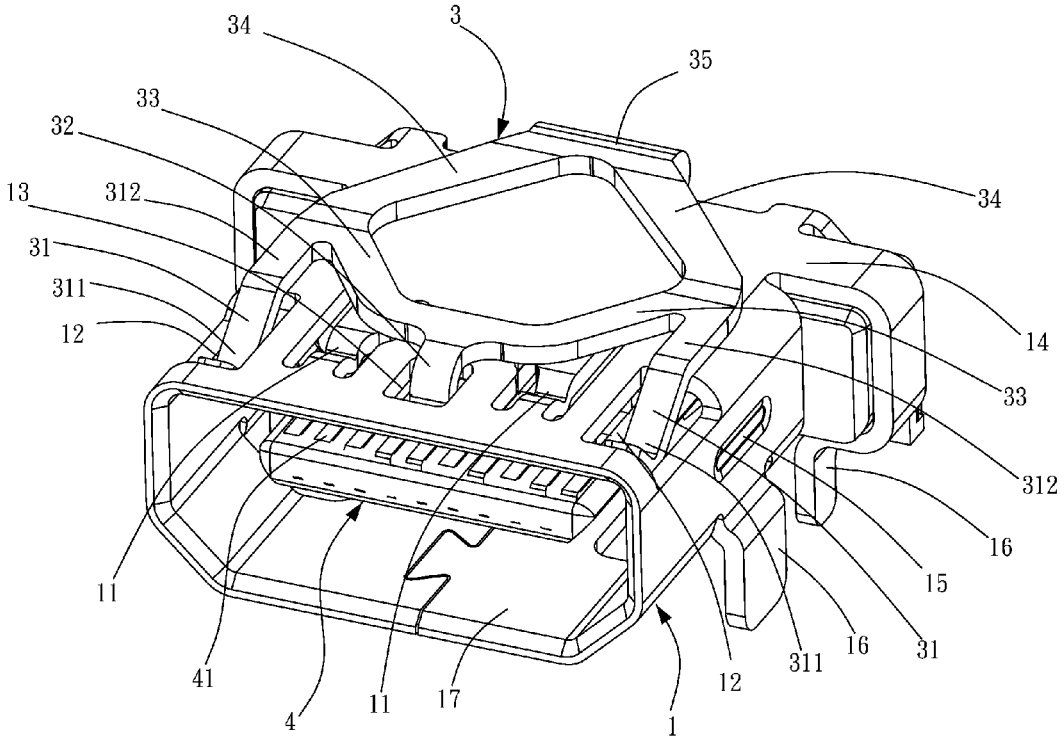
FIG. 4 is a perspective view of the HDMI connector with anti-misinsertion structure having a rhomboidal plate according to the present invention.
Figure 5A:
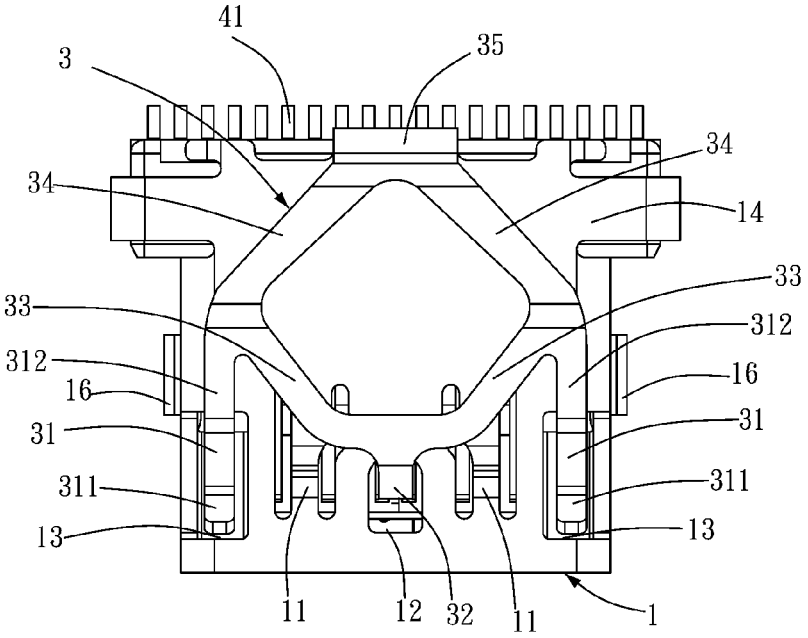
FIG. 5A is a top view of the HDMI connector with anti-misinsertion structure having a rhomboidal plate according to the present invention.
Figure 5B:
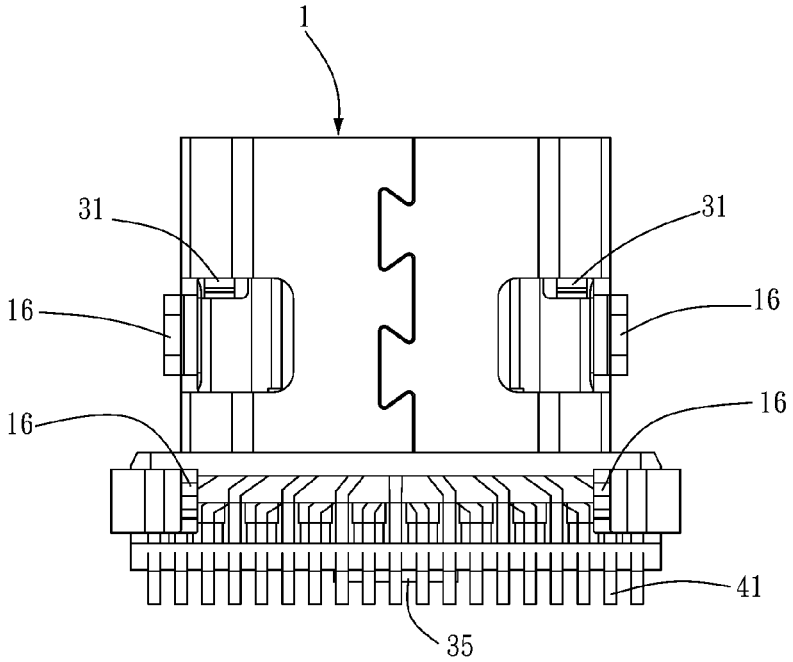
FIG. 5B is a bottom view of the HDMI connector with anti-misinsertion structure having a rhomboidal plate according to the present invention.
Figure 5C:
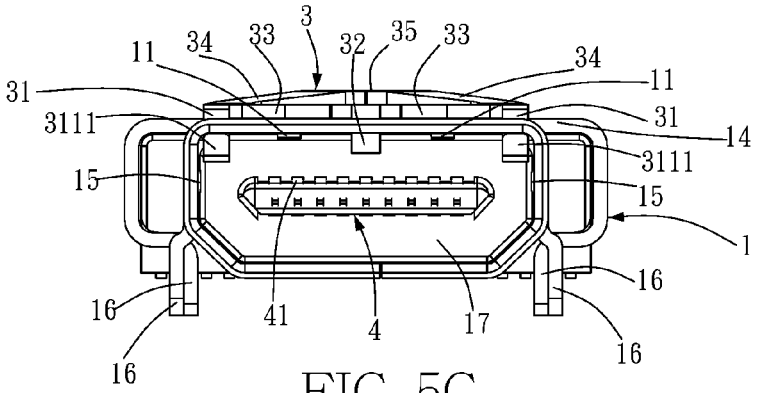
FIG. 5C is a front view of the HDMI connector with anti-misinsertion structure having a rhomboidal plate according to the present invention.
Figure 5D:
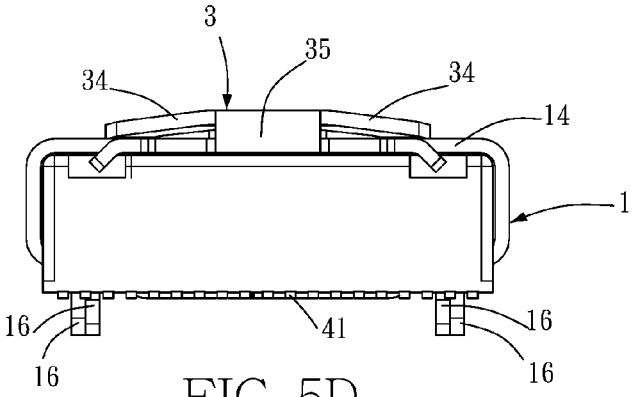
FIG. 5D is a rear view of the HDMI connector with anti-misinsertion structure having a rhomboidal plate according to the present invention.
Figure 5E:
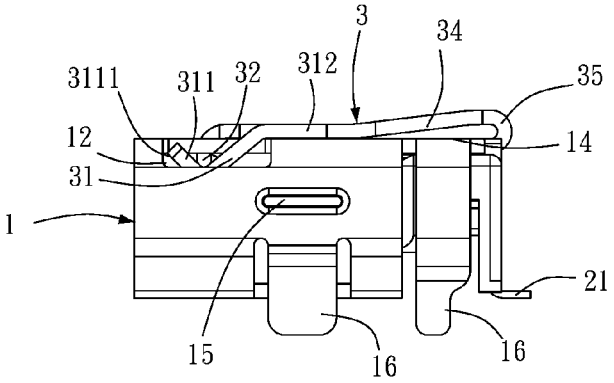
FIG. 5E is a lateral view of the HDMI connector with anti-misinsertion structure having a rhomboidal plate according to the present invention.

Referring to FIG. 1, FIG. 2, and FIGS. 3A-3E, there are shown a perspective view, top view, bottom view, front view, rear view, and lateral view of a HDMI connector with anti-misinsertion structure having a U-shaped plate according a preferred embodiment of the present invention. As shown in the diagrams, a HDMI connector with anti-misinsertion structure according to the present invention comprises a metallic case 1, a U-shaped plate 2, and a terminal base 4. A plurality of press resilient plates 11 is disposed at the front end of the upper surface of the metallic case 1. Two channels 12 and an opening 13 are disposed at the two lateral sides and the middle of the metallic case 1, respectively. A rib portion 14 is disposed at the rear end of the upper surface of the metallic case 1. At least one engagement portion 15 and a plurality of pins 16 are disposed on two lateral sides of the metallic case 1. The metallic case 1 has therein an insertion space 17 into which a HDMI plug 5 is inserted. The U-shaped plate 2 is disposed on the upper surface of the metallic case 1, has front ends at which two push resilient plates 21 and a block 22 are disposed, respectively, has rear ends which extend to form two front arm portions 23 connected to the push resilient plates 21 and the block 22, and extends backward to form two rear arm portions 241, 242 and two base portions 251, 252. The terminal base 4 is installed a terminal set 41. The U-shaped plate 2 is connected to the metallic case 1 by means of the base portions 251, 252. The block 22 is received in the opening 13 of the metallic case 1. The block 22 abuts against a front-end top portion 61 of a non-HDMI plug (such as a USB plug 6) to prevent the non-HDMI plug from being inserted into the insertion space 17.

Both the front end and the rear end of the plurality of press resilient plates 11 of the metallic case 1 are integrally formed with the metallic case 1. Once the HDMI plug 5 is inserted into the HDMI connector, the HDMI plug 5 and the HDMI connector will be firmly engaged with each other, such that the HDMI plug 5 and the HDMI connector are unlikely to separate. These channels 12 disposed at the metallic case 1 receive the push resilient plates 21, respectively. The push resilient plates 21 each have a hook portion 211 and an extension portion 212. A push surface 2111 of the hook portion 211 can contact with a front-end top portion 51 of the HDMI plug 5. The extension portion 212 is connected to the front arm portions 23. The rib portion 14 of the metallic case 1 is integrally formed with the base portions 251, 252. A rear arm portion 241 of the U-shaped plate 2 extends straightly to the base portion 251 at the rear end of the metallic case 1. Another rear arm portion 242 of the U-shaped plate 2 extends upward and vertically to the base portion 252 disposed at the rear end of the metallic case 1. The front arm portions 23 of the U-shaped plate 2 are connected to two push resilient plates 21 disposed on the left and right sides, the centrally-positioned block 22, and the rear arm portions 241, 242 to form a unitary structure, so as to speed up the manufacturing process thereof, cut material costs, and boost the linking-up and stopping strength of the anti-misinsertion structure and an upward pushing force generated from the insertion of the HDMI plug 5, to render it easy for the HDMI plug 5 to be inserted into the HDMI connector and further prevent the non-HDMI plug from being inserted into the HDMI connector wrongly.

Referring to FIGS. 4 and 5A-5E, there are shown a perspective view, top view, bottom view, front view, rear view, and lateral view of the HDMI connector with anti-misinsertion structure having a rhomboidal plate according to the present invention, respectively. As shown in the diagrams, a HDMI connector with anti-misinsertion structure according to the present invention comprises a metallic case 1, a rhomboidal plate 3, and a terminal base 4. The plurality of press resilient plates 11 is disposed at the front end of the upper surface of the metallic case 1. Two channels 12 and an opening 13 are disposed at the two lateral sides and the middle of the metallic case 1, respectively. A rib portion 14 is disposed at the rear end of the upper surface of the metallic case 1. At least one engagement portion 15 and the plurality of pins 16 are disposed on the two lateral sides of the metallic case 1. The metallic case 1 has therein an insertion space 17 into which the HDMI plug 5 is inserted. The rhomboidal plate 3 is disposed on the upper surface of the metallic case 1, has front ends at which two push resilient plates 31 and a block 32 are disposed, respectively, has rear ends which extend to form two front arm portions 33 connected to the push resilient plates 31 and the block 32, and extends backward to form two rear arm portions 34 and a base portion 35. The terminal base 4 is installed a terminal set 41. The rhomboidal plate 3 is connected to the metallic case 1 by means of the base portion 35. The block 32 is received in the opening 13 of the metallic case 1. The block 32 abuts against the front-end top portion 61 of a non-HDMI plug (such as a USB plug 6) to prevent the non-HDMI plug from being inserted into the insertion space 17.

Both the front end and the rear end of the plurality of press resilient plates 11 of the metallic case 1 are integrally formed with the metallic case 1. Once the HDMI plug 5 is inserted into the HDMI connector, the HDMI plug 5 and the HDMI connector will be firmly engaged with each other, such that the HDMI plug 5 and the HDMI connector are unlikely to separate. These channels 12 disposed at the metallic case 1 receive the push resilient plates 31, respectively. The push resilient plates 31 each have a hook portion 311 and an extension portion 312. The push surface 3111 of the hook portion 311 can contact with the front-end top portion 51 of the HDMI plug 5. The extension portion 312 is connected to the front arm portions 33. The rib portion 14 of the metallic case 1 is integrally formed with the base portions 35. The rear arm portions 34 of the rhomboidal plate 3 extend straightly and obliquely backward to be connected before extending to the base portions 35 at the rear end of the metallic case 1. The front arm portions 33 of the rhomboidal plate 3 are connected to the two push resilient plates 31 disposed on the left and right respectively, the centrally-positioned block 32, and the rear arm portions 34 to form a unitary structure, so as to further speed up the manufacturing process, cut material costs, and boost the linking-up and stopping strength of the anti-misinsertion structure and an upward pushing force generated from the insertion of the HDMI plug 5, to render it easy for the HDMI plug 5 to be inserted into the HDMI connector and further prevent the non-HDMI plug from being inserted into the HDMI connector wrongly.

Furthermore, the U-shaped plate 2 is integrally formed with the metallic case 1 by means of the base portions 251, 252, whereas a rhomboidal plate 3 is integrally formed with the metallic case 1 by means of the base portions 35; however, it is feasible that the base portions 251, 252 of the U-shaped plate 2 are connected to the metallic case 1 in a fixed manner or a movably manner, and feasible that the base portions 35 of the rhomboidal plate 3 are connected to the metallic case 1 in a fixed manner or a movably manner, such that the plate and the metallic case 1 have a two-piece relationship therebetween.

Figure 6A:
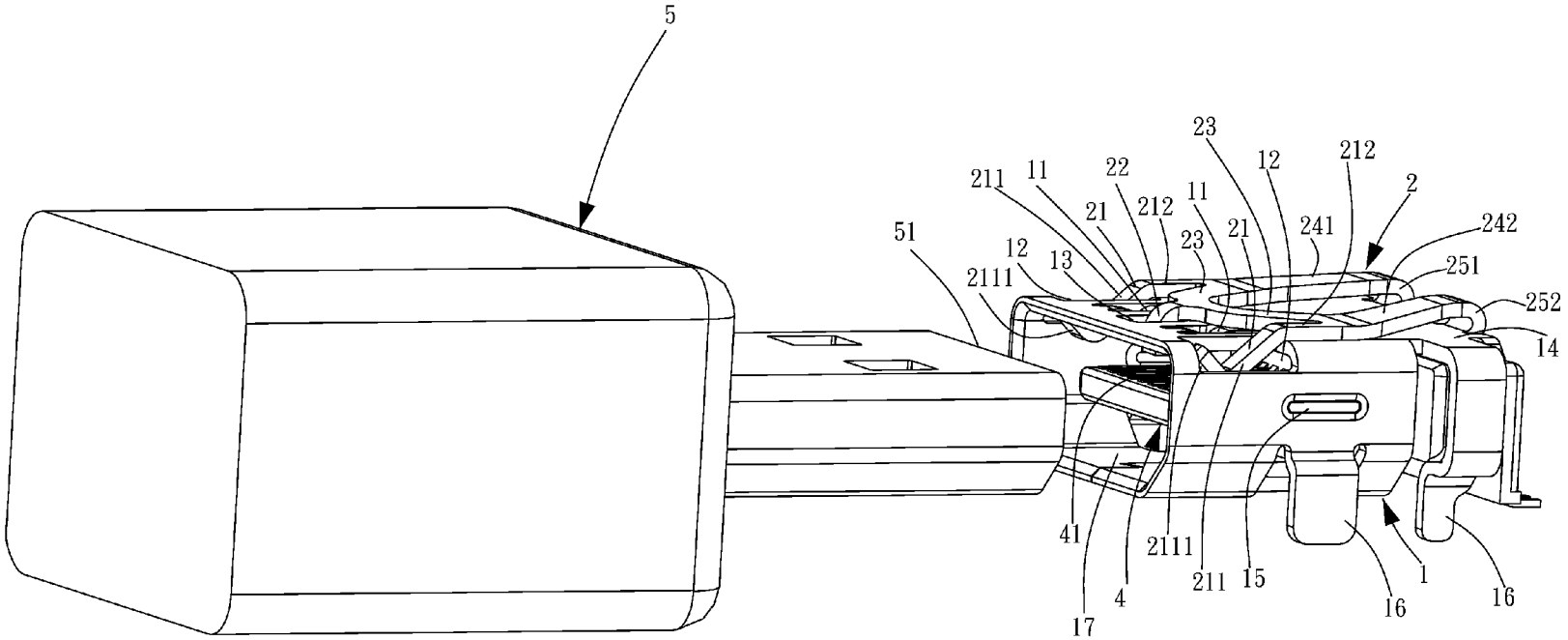
FIG. 6A is a schematic perspective view of a HDMI connector with anti-misinsertion structure and a HDMI plug before being inserted thereinto according to the present invention.
Figure 6B:
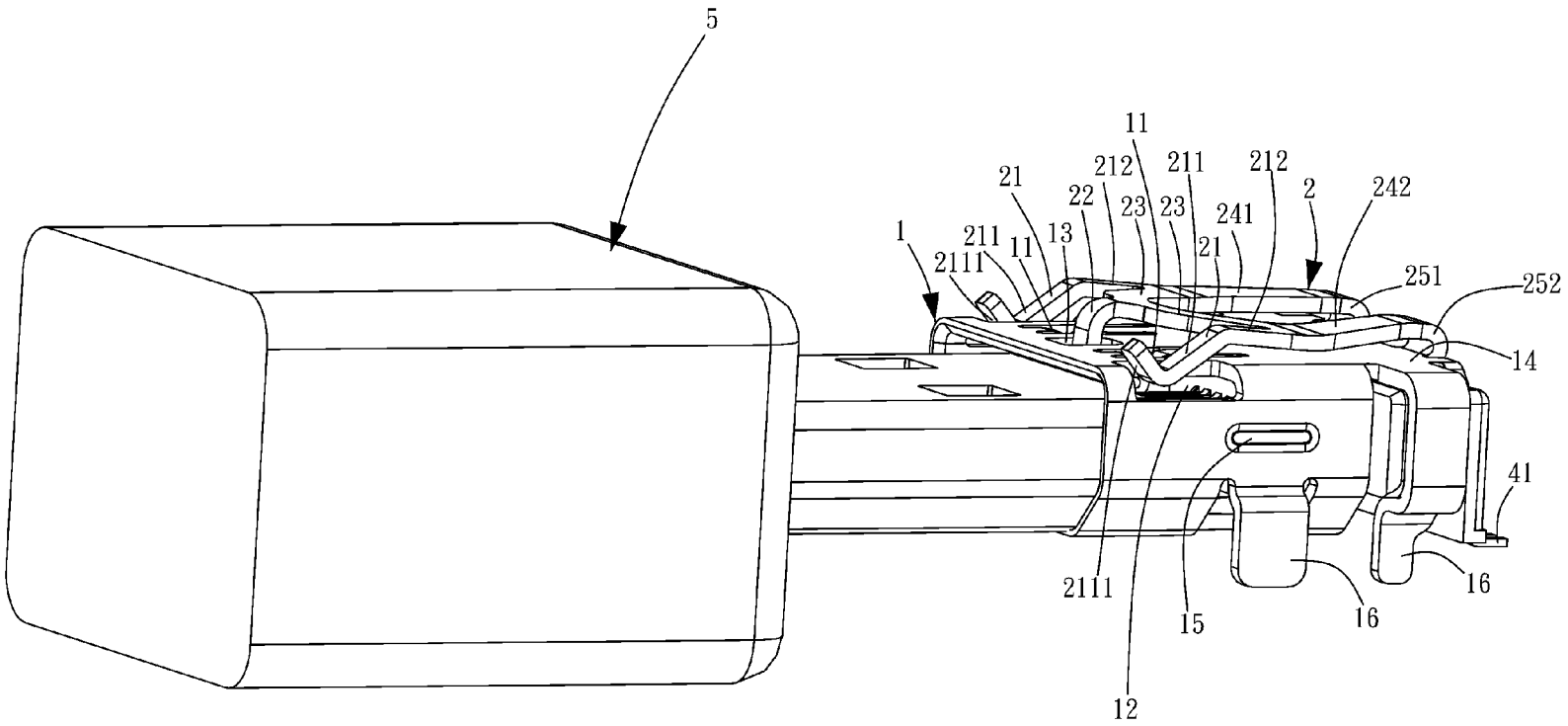
FIG. 6B is a schematic perspective view of a HDMI connector with anti-misinsertion structure and the HDMI plug after being inserted thereinto according to the present invention.

Referring to FIGS. 6A, 6B, there are shown schematic perspective views of a HDMI connector with anti-misinsertion structure and the HDMI plug 5 before and after being inserted thereinto according to the present invention, respectively. As shown in the diagrams, the push resilient plates 21 are connected to the block 22 by means of the front arm portions 23. After the HDMI plug 5 has been inserted into the insertion space 17 of the HDMI connector, the front-end top portion 51 of the HDMI plug 5 pushes the push surface 2111 of a hook portion 211 of the push resilient plates 21 upward to thereby move the front arm portions 23 and the block 22 upward synchronously, whereas the block 22 is pushed upward to get out of the insertion space 17 of the HDMI connector, thereby disabling the stopping function of the block 22, and in consequence the HDMI plug 5 can be successfully inserted into the insertion space 17 of the HDMI connector.

Figure 7A:
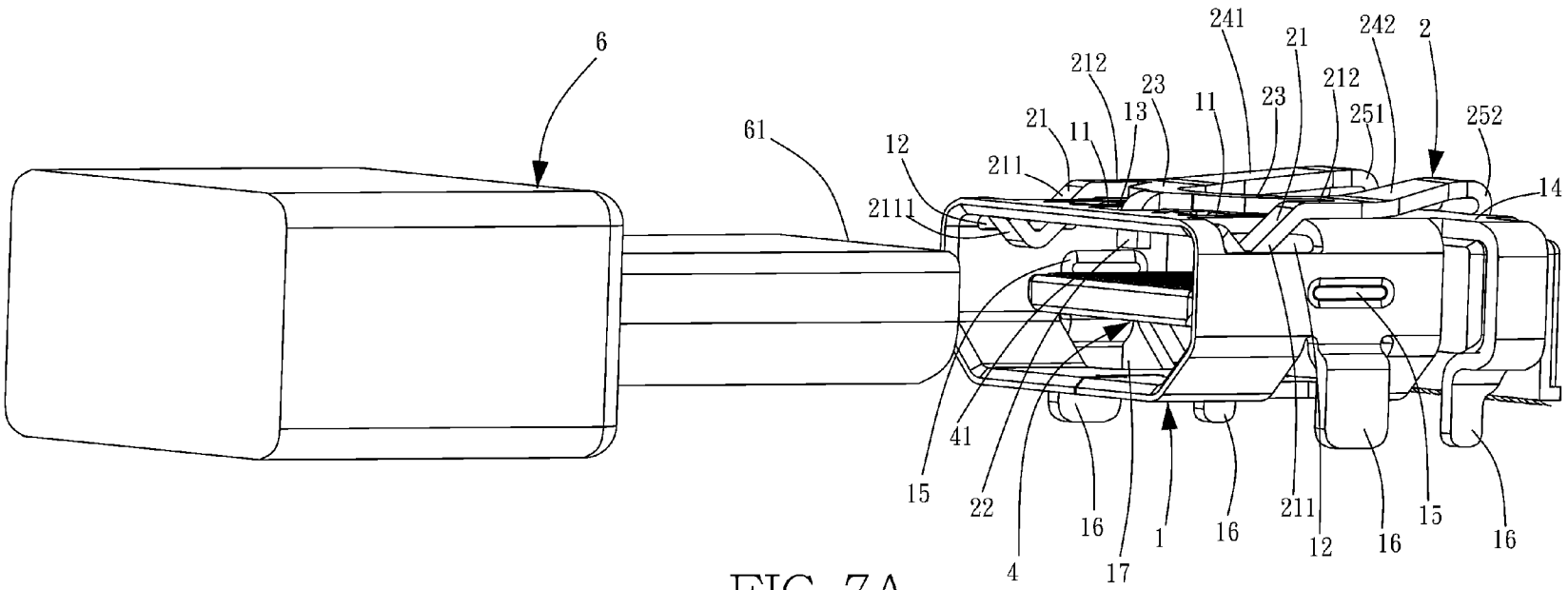
FIG. 7A is a schematic perspective view of a HDMI connector with anti-misinsertion structure and a non-HDMI plug before being inserted thereinto according to the present invention.
Figure 7B:
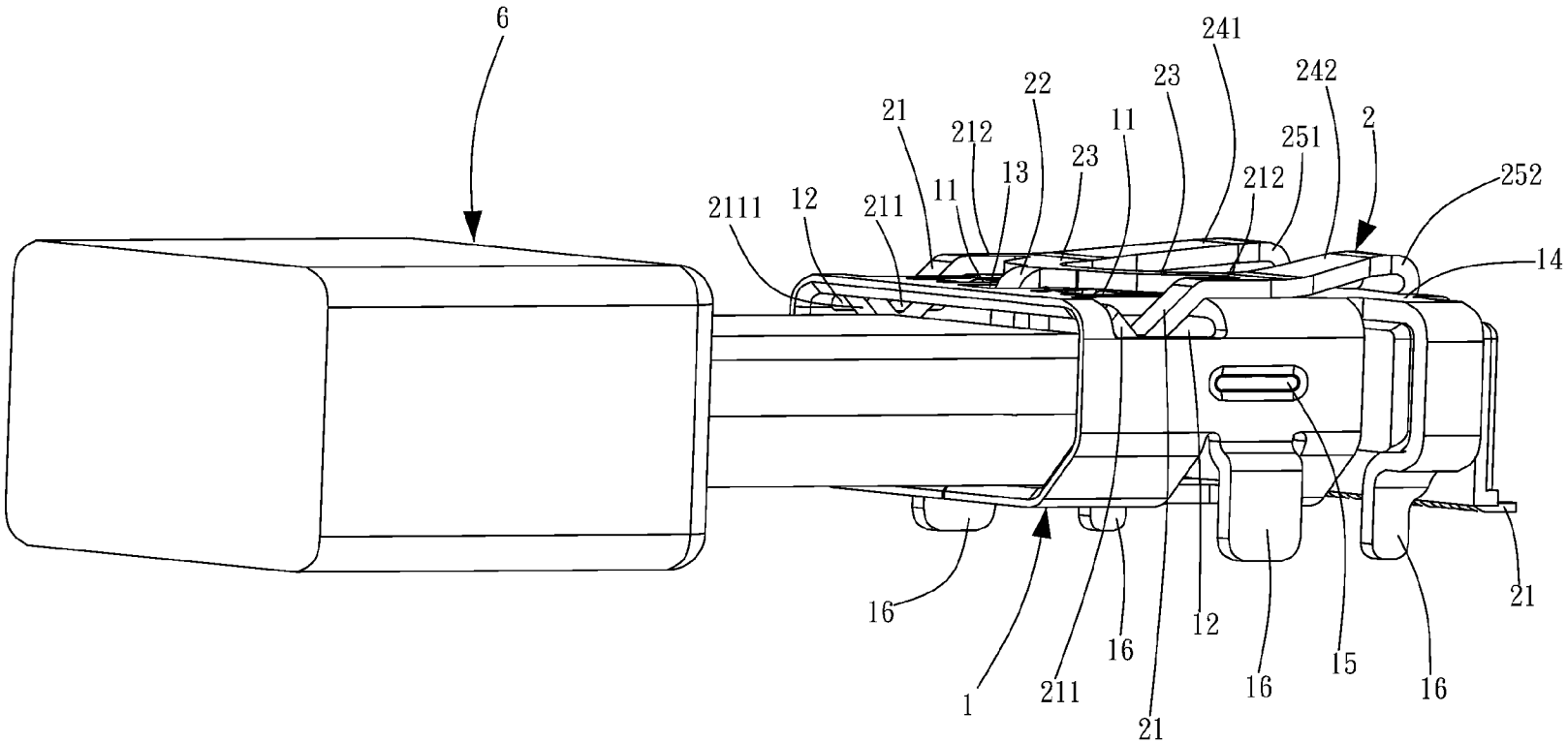
FIG. 7B is a schematic perspective view of a HDMI connector with anti-misinsertion structure and the non-HDMI plug after being inserted thereinto according to the present invention.
Figure 8:
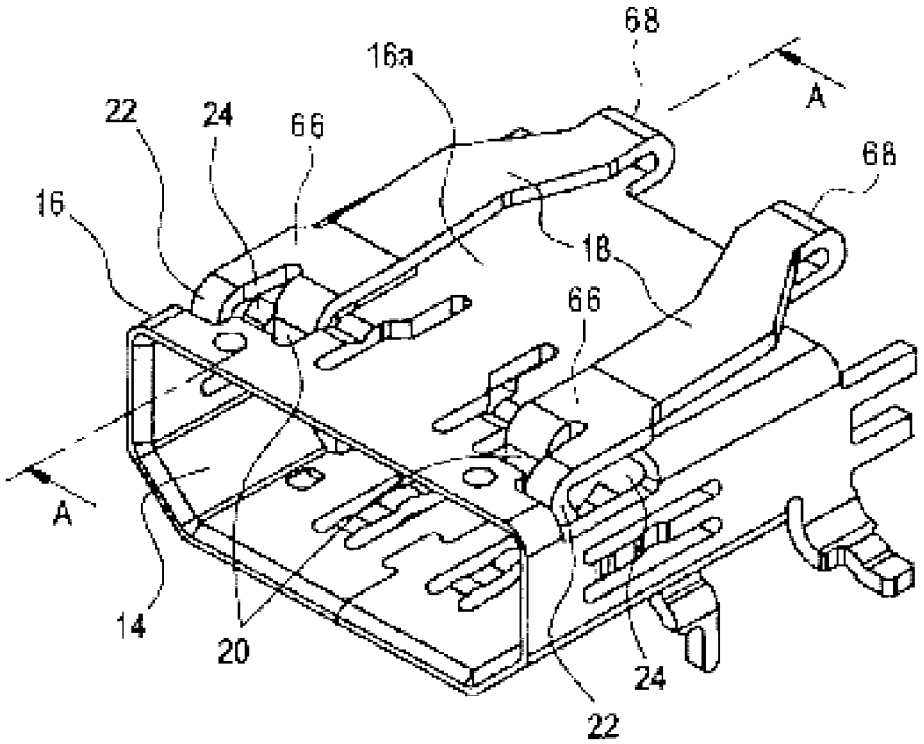
FIG. 8 (PRIOR ART) is a perspective view of a connector with a conventional anti-misinsertion structure.

Referring to FIGS. 7A, 7B, there are shown schematic perspective views of a HDMI connector with anti-misinsertion structure and a non-HDMI plug before and after being inserted thereinto according to the present invention, respectively. As shown in the diagrams, the push resilient plates 21 are connected to the block 22 by means of the front arm portions 23. After the non-HDMI plug (such as a USB plug 6) has been inserted into the insertion space 17 of the HDMI connector, the front-end top portion 61 of the non-HDMI plug cannot push the push surface 2111 of the hook portion 211 of the push resilient plates 21 upward, and thus the front arm portions 23 and the block 22 do not move upward synchronously, such that the stopping function of the block 22 is enabled. As a result, the non-HDMI plug cannot be pushed and inserted into the insertion space 17 of the HDMI connector. Furthermore, the stopping function of the anti-misinsertion structure prevents the non-HDMI plug from being improperly inserted into the terminal base 4 and the terminal set 41 of the HDMI connector to cause damage thereto.

In conclusion, considering the aforesaid disclosure, the present invention can achieve the anticipated objectives. The present invention provides a HDMI connector with anti-misinsertion structure, wherein the anti-misinsertion structure and a metallic case are integrally formed as a unitary structure to thereby speed up the manufacturing process thereof, cut material costs so as to reduce the overall manufacturing costs, and boost linking-up and stopping strength of the anti-misinsertion structure so as to prevent the non-HDMI plug from being inserted into the HDMI connector.

What is claimed is:

1. A HDMI connector with anti-misinsertion structure, comprising:

a metallic case, wherein a plurality of press resilient plates is disposed at a front end of an upper surface of the metallic case, wherein two channels and an opening are disposed at two lateral sides and a middle of the metallic case, respectively, wherein a rib portion is disposed at a rear end of the upper surface of the metallic case, wherein at least one engagement portion and a plurality of pins are disposed on the two lateral sides of the metallic case, the metallic case having therein an insertion space into which a HDMI plug is inserted;

a U-shaped plate disposed on the upper surface of the metallic case, having front ends at which two push resilient plates and a block are disposed, respectively, having rear ends extending to form two front arm portions connected to the push resilient plates and the block, and extending backward to form two rear arm portions and two base portions; and a terminal base is installed thereon a terminal set;

wherein the U-shaped plate is connected to the metallic case by means of the base portions, wherein the block is received in the opening of the metallic case, wherein the block abuts against a front-end top portion of a non-HDMI plug to prevent the non-HDMI plug from being inserted into the insertion space.

2. A HDMI connector with anti-misinsertion structure, comprising:

a metallic case, wherein a plurality of press resilient plates is disposed at a front end of an upper surface of the metallic case, wherein two channels and an opening are disposed at two lateral sides and a middle of the metallic case, respectively, wherein a rib portion is disposed at a rear end of the upper surface of the metallic case, wherein at least one engagement portion and a plurality of pins are disposed on the two lateral sides of the metallic case, the metallic case having therein an insertion space into which a HDMI plug is inserted;

a rhomboidal plate disposed on the upper surface of the metallic case, having front ends at which two push resilient plates and a block are disposed, respectively, having rear ends extending to form two front arm portions connected to the push resilient plates and the block, and extending backward to form two rear arm portions and a base portion; and a terminal base is installed thereon a terminal set;

wherein the rhomboidal plate is connected to the metallic case by means of the base portion, wherein the block is received in the opening of the metallic case, wherein the block abuts against a front-end top portion of a non-HDMI plug to prevent the non-HDMI plug from being inserted into the insertion space.

3. The HDMI connector with anti-misinsertion structure as claimed in claim 1 or 2, wherein both a front end and a rear end of the plurality of press resilient plates of the metallic case are integrally formed with the metallic case.

4. The HDMI connector with anti-misinsertion structure as claimed in claim 1 or 2, wherein these channels disposed at the metallic case receive the push resilient plates, respectively.

5. The HDMI connector with anti-misinsertion structure as claimed in claim 1 or 2, wherein the rib portion of the metallic case is integrally formed with the base portions.

6. The HDMI connector with anti-misinsertion structure as claimed in claim 1 or 2, wherein the push resilient plates each have a hook portion and an extension portion, and a push surface of the hook portion can contact with the front-end top portion of a HDMI plug, wherein the extension portion is connected to the front arm portions.

7. The HDMI connector with anti-misinsertion structure as claimed in claim 1, wherein a rear arm portion of the U-shaped plate extends straightly to the base portions at a rear end of the metallic case, and another rear arm portion of the U-shaped plate extends upward and vertically to the base portions at a rear end of the metallic case.

8. The HDMI connector with anti-misinsertion structure as claimed in claim 1, wherein the U-shaped plate and the metallic case are integrally formed as a unitary or a two-piece structure and connected to each other by means of the base portions.

9. The HDMI connector with anti-misinsertion structure as claimed in claim 2, wherein the rear arm portions of the rhomboidal plate extend straightly and obliquely backward to be connected before extending to the base portions at a rear end of the metallic case.

10. The HDMI connector with anti-misinsertion structure as claimed in claim 2, wherein the rhomboidal plate and the metallic case are integrally formed as a unitary or a two-piece structure and connected to each other by means of the base portions.

* * * * *